US011350762B2

(12) United States Patent
Chen

(10) Patent No.: US 11,350,762 B2
(45) Date of Patent: Jun. 7, 2022

(54) SWING DINING CHAIR

(71) Applicant: NINGBO HAWK ELECTRICAL APPLIANCE CO., LTD, Zhejiang (CN)

(72) Inventor: Jianlun Chen, Ningbo (CN)

(73) Assignee: NINGBO HAWK ELECTRICAL APPLIANCE CO., LTD.

( * ) Notice: Subject to any disclaimer, the term of this patent is extended or adjusted under 35 U.S.C. 154(b) by 140 days.

(21) Appl. No.: 16/987,169

(22) Filed: Aug. 6, 2020

(65) Prior Publication Data

US 2021/0059429 A1 Mar. 4, 2021

(51) Int. Cl.
*A47D 1/08* (2006.01)
*A47D 1/04* (2006.01)

(52) U.S. Cl.
CPC ..... *A47D 1/08* (2013.01); *A47D 1/04* (2013.01)

(58) Field of Classification Search
None
See application file for complete search history.

(56) References Cited

U.S. PATENT DOCUMENTS 6,334,652 B1 * 1/2002 Chen ..... A47D 13/105 297/256.13
6,421,901 B2 * 7/2002 Sitarski ..... A47D 13/105 297/130
8,550,556 B2 * 10/2013 Asbach ..... A47D 13/105 297/281
2001/0028184 A1 * 10/2001 Sitarski ..... A47D 13/105 297/118
2009/0189422 A1 * 7/2009 Lu ..... A47D 1/002 297/217.1
2010/0060059 A1 * 3/2010 Chen ..... A47D 13/105 297/328
2010/0320810 A1 * 12/2010 Chen ..... A47D 1/08 297/118
2011/0227375 A1 * 9/2011 Asbach ..... A47D 1/0085 297/130
2021/0401190 A1 * 12/2021 Tyneski ..... A47D 11/02

* cited by examiner

*Primary Examiner* — David E Allred

(57) ABSTRACT

A swing dining chair comprising supporting frames, swing arms and a chair body. The chair body comprises a seat and a backrest. A multi-stage included-angle adjustment device is arranged between the seat and the backrest. The swing arm is provided with a lifting base, and the seat is connected with the lifting base. A first locking device is arranged between the seat and the lifting base for locking the seat. A second locking device is provided for locking the first locking device. A third locking device is arranged between the seat and the lifting base for locking the multi-stage included-angle adjustment device. A fourth locking device is arranged between the swing arm and the supporting frame for locking the swing arm. The lifting base is provided with an unlocking mechanism for unlocking the fourth locking device. The present disclosure has a simple structure, achieves convenient operation, and avoids maloperation.

10 Claims, 11 Drawing Sheets

SWING DINING CHAIR

TECHNICAL FIELD

This disclosure generally relates to the technical field of children's dining chairs, and more particularly, to a swing dining chair.

BACKGROUND

Presently, children's swings and dining chairs have become the necessities during the children's growth. To save cost, conventional swing dining chairs are designed to be transformable between a swing and a dining chair. Namely, when a swing for children's entertainment is wanted, it may be transformed into a swing, and when a dining chair for children's eating is wanted, it may be transformed into a dining chair. Normally, the seat portion and the backrest of the swing dining chair form an adjustable included angle ranging from 95° to 180°. However, when used as a swing, a child may be easily thrown out of the swing if the included angle formed by the seat portion and the backrest is excessively large. Moreover, as the transforming process includes multiple steps and most of the conventional swing dining chairs are lack of safe and reliable locking structures, hidden dangers may be caused by users' maloperation during use. Although some swing dining chairs sold on the market are designed with a locking structure, the complicated structural design inevitably leads to high manufacturing cost and inconvenient operation.

SUMMARY

The purpose of the present disclosure is to provide a swing dining chair, which has a simple structure, achieves convenient operation and high safety, and avoids the maloperation.

To achieve the above purpose, the present disclosure adopts the following technical solution: a swing dining chair comprising supporting frames, swing arms and a chair body, wherein the swing arm is rotatably connected with the supporting frame, and a driving device for driving the swing arm to swing is arranged on the supporting frame, wherein the chair body comprises a seat portion and a backrest, and the seat portion is rotatably connected with the backrest, wherein a multi-stage included-angle adjustment device is arranged between the seat portion and the backrest, and the multi-stage included-angle adjustment device is used for adjusting the position of the backrest relative to the seat portion, thereby enabling the seat portion and the backrest to stay at multiple included-angle stages, wherein the included-angle stages comprise a swing included-angle stage and a non-swing included-angle stage, wherein the swing arm is provided with a lifting base, which is in sliding fit with the swing arm, wherein the seat portion is rotatably connected with the lifting base, and the seat portion possesses at least a first angle position and a second angle position relative to the lifting base, wherein a first locking device is arranged between the seat portion and the lifting base for locking the seat portion such that the seat portion is relatively fixed with the lifting base, wherein the seat portion is provided with a second locking device for locking the first locking device, wherein the seat portion is provided with a first unlocking device for unlocking the second locking device, wherein when the backrest is adjusted to the swing included-angle stage from the non-swing included-angle stage relative to the seat portion, the first unlocking mechanism unlocks the second locking device, wherein a third locking device is arranged between the seat portion and the lifting base, and the third locking device is in linkage with the lifting base, wherein when the seat portion is adjusted from the first angle position to the second angle position relative to the lifting base, the lifting base propels the third locking device to lock the multi-stage included-angle adjustment device at the swing included-angle stage relative to the seat portion, wherein a fourth locking device is arranged between the swing arm and the supporting frame, wherein the fourth locking device is used for locking the swing arm such that the swing arm is fixed relative to the supporting frame, wherein the fourth locking device is located on the sliding track of the lifting base, wherein the lifting base is provided with a second unlocking mechanism for unlocking the fourth locking device, and the second unlocking mechanism is in linkage with the seat portion, wherein when the seat portion is adjusted from the first angle position to the second angle position relative to the lifting base, the seat portion propels the second unlocking mechanism to act.

In another aspect of the present disclosure, the first locking device comprises a locking disc arranged on the lifting base and a pulling plate which is arranged on the seat portion and corresponds to the locking disc. The pulling plate slidably interacts with the seat portion. The locking disc is provided with a locking groove, and the pulling plate is provided with a locking pin. The seat portion is provided with a pulling plate spring matched with the pulling plate. The pulling plate spring abuts against the pulling plate, thereby enabling the locking pin to insert into the locking groove.

In another aspect of the present disclosure, the second locking device comprises a pin hole formed in the pulling plate and a shift pin which is arranged on the seat portion and corresponds to the pulling plate. The shift pin is slidably interacts with the seat portion, and the shift pin is in linkage with a first unlocking mechanism. The seat portion is provided with a pin spring matched with the shift pin, and the pin spring abuts against the shift pin, thus enabling the shift pin to insert into the pin hole.

In another aspect of the present disclosure, the first unlocking mechanism comprises a sliding connection rod arranged in the seat portion, and the sliding connection rod is in linkage with the backrest. The shift pin is provided with an inserting hole for receiving the end portion of the sliding connection rod, and the hole wall of the inserting hole is provided with a pin inclined surface. The end portion of the sliding connection rod is provided with a connection rod inclined surface matched with the pin inclined surface. When the backrest is adjusted to the swing included-angle stage from the non-swing included-angle stage relative to the seat portion, the sliding connection rod moves towards the shift pin, and the connection rod inclined surface abuts against the pin inclined surface, thereby enabling the shift pin to escape from the pin hole.

In another aspect of the present disclosure, the sliding connection rod is provided with a linkage post, and the backrest is provided with a linkage baffle. When the backrest is adjusted to the swing included-angle stage from the non-swing included-angle stage relative to the seat portion, the linkage baffle abuts against and is in linkage with the linkage post.

In another aspect of the present disclosure, the third locking device comprises a locking button movably arranged on the seat portion and an inclined surface step which is arranged on the lifting base and abuts against the locking button. When the seat portion is adjusted from the first angle position to the second angle position relative to the lifting base, the inclined surface step propels to locking button to move such that the multi-stage included-angle adjustment device is locked by the locking button. The locking button is provided with a button spring for ensuring that the locking button always possesses a motion tendency of unlocking the multi-stage included-angle adjustment device.

In another aspect of the present disclosure, the multi-stage included-angle adjustment device comprises a stage block arranged on the seat portion, and the stage block is provided with an arc-shaped groove matched with the rotation route of the backrest. A positioning block is movably arranged on the backrest, and a pulling cord in linkage with the positioning block is arranged on the backrest. A positioning pin in sliding fit with the arc-shaped groove is arranged on the positioning block. The groove wall of the arc-shaped groove is provided with a plurality of stage grooves for receiving the positioning pin, and the plurality of stage grooves are arranged at intervals. A positioning block spring is arranged between the positioning block and the backrest, and the positioning block spring is used for ensuring that the positioning pin always possesses a motion tendency of being clamped into the stage groove.

In another aspect of the present disclosure, the arc-shaped groove of the stage block is provided with a through-hole, and the through-hole is formed between the stage groove corresponding to the swing included-angle stage and the stage groove corresponding to the non-swing included-angle stage adjacent to the swing included-angle stage. One end of the locking button far away from the inclined surface step is movably inserted into the through-hole.

In another aspect of the present disclosure, the fourth locking device comprises a locking shell, a locking base, a locking tongue and a trigger button. The locking shell is fixedly arranged on the swing arm, and the locking base is arranged on the supporting frame. The locking tongue is transversely movably arranged in the locking shell. A first return spring is arranged in the locking shell, and the first return spring is used for ensuring that the locking tongue always possesses a motion tendency of being clamped into the locking hole. The trigger button is longitudinally movably arranged in the locking shell. The upper end of the trigger button is in linkage with a second unlocking mechanism, and the lower end of the trigger button is in linkage with the locking tongue. When the trigger button is pressed, the trigger button pushes the locking tongue to move transversely against the elastic force of the first return spring, thus unlocking the fourth locking device.

In another aspect of the present disclosure, the second unlocking mechanism comprises an unlocking button which is movably arranged in the lifting base and is in linkage with the trigger button, and an arc-shaped portion which is arranged on the seat portion and is in linkage with the unlocking button. The center of the arc-shaped portion is eccentrically arranged relative to the rotation fulcrum of the chair body and the lifting base. The lifting base is internally provided with a second return spring abutting against the unlocking button, and the second return spring is used for ensuring that the unlocking button always possesses a motion tendency of being away from the trigger button.

Compared with the prior art, the present disclosure has the following advantages:

Through improving the conventional swing dining chairs, the present disclosure achieves a simple structure and a convenient operation. The multi-stage linkage interlocking structure adopted in the present disclosure is capable of avoiding the maloperation, realizing a safe use and preventing hidden dangers from occurring.

More specifically, through the swing arm arranged on the lifting base, the seat portion is rotatably connected with the lifting base. A first locking device is arranged between the seat portion and the lifting base for locking the seat portion, thus making the seat portion unable to rotate relative to the lifting base. Meanwhile, a second locking device interacting with the first locking device and a sliding connection rod interacting with the second locking device are respectively arranged on the seat portion. When the backrest stays at the non-swing included-angle stage relative to the seat portion, the second locking device locks the first locking device, and the first locking device further locks the seat portion. At this point, the seat portion cannot rotate relative to the lifting base, namely, unable to be transformed into a swing. While the backrest is adjusted to the swing included-angle stage from the non-swing included-angle stage relative to the seat portion, the backrest propels the sliding connection rod to move such that the sliding connection rod propels the second locking device to unlock the first locking device. At this time, the first locking device is in a moving state, allowing a user to transform the dining chair state into the swing state. Furthermore, as a third locking device is arranged between the seat portion and the lifting base, when the backrest stays at the swing included-angle stage relative to the seat portion (namely, the first locking device is unlocked) and the seat portion is adjusted from the first angle position to the second angle position, the third locking device is triggered to act, thus further locking the multi-stage included-angle adjustment device. Therefore, when the swing dining chair is in a swing state, the backrest cannot be adjusted anymore, ensuring that the backrest and the seat portion form a safe included angle. Moreover, the present disclosure is provided with a fourth locking device and a second unlocking mechanism for unlocking the fourth locking device. The second unlocking mechanism unlocks the fourth locking device only if the present disclosure is in a swing state, which also effectively prevents the maloperation.

BRIEF DESCRIPTION OF THE DRAWINGS

In FIGS. 1-15: 1—Swing Arm, 2—Chair Body, 21—Seat Portion, 211—Pulling Plate Sliding Groove, 212—Pin Sliding Groove, 213—Connection Rod Sliding Groove, 214—Arc-shaped Portion, 22—Backrest, 221—Linkage Baffle, 3—Supporting Frame, 4—Multi-stage Included-angle Adjustment Device, 41—Stage Block, 42—Arc-shaped Groove, 43—Positioning Block, 44—Positioning Pin, 45—Stage Groove, 451—Swing Stage Groove, 452—The First Non-swing Stage Groove, 453—The Second Non-swing Stage Groove, 46—Through-hole, 5—Lifting Base, 51—Lifting Button, 52—Lifting Spring, 53—Slideway, 61—Locking Disc, 611—Locking Groove, 612—Swing Positioning Groove, 62—Pulling Plate, 621—Locking Pin, 622—Arc-shaped Surface, 71—Pin Hole, 72—Shift Pin, 721—Inserting Hole, 722—Pin Inclined Surface, 8—Sliding Connection Rod, 82—Connection Rod Inclined Surface, 83—Linkage Post, 91—Locking Button, 911—Spherical Surface, 92—Inclined Surface Step, 10—Driving Device, 11—Height Positioning Hole, 111—Locking Shell, 1111—Shielding Portion, 112—Locking Base, 1121—Locking Hole, 1122—Locking Base Sliding Groove, 113—Locking Tongue, 1131—Locking Post, 1132—Locking Tongue Inclined Surface, 114—Trigger Button, 1141—Button Inclined Surface, 115—Joint Rod, 121—Unlocking Button, 1211—The First Rod Portion, 1212—The Second Rod Portion.

DETAILED DESCRIPTION

Figure 1:
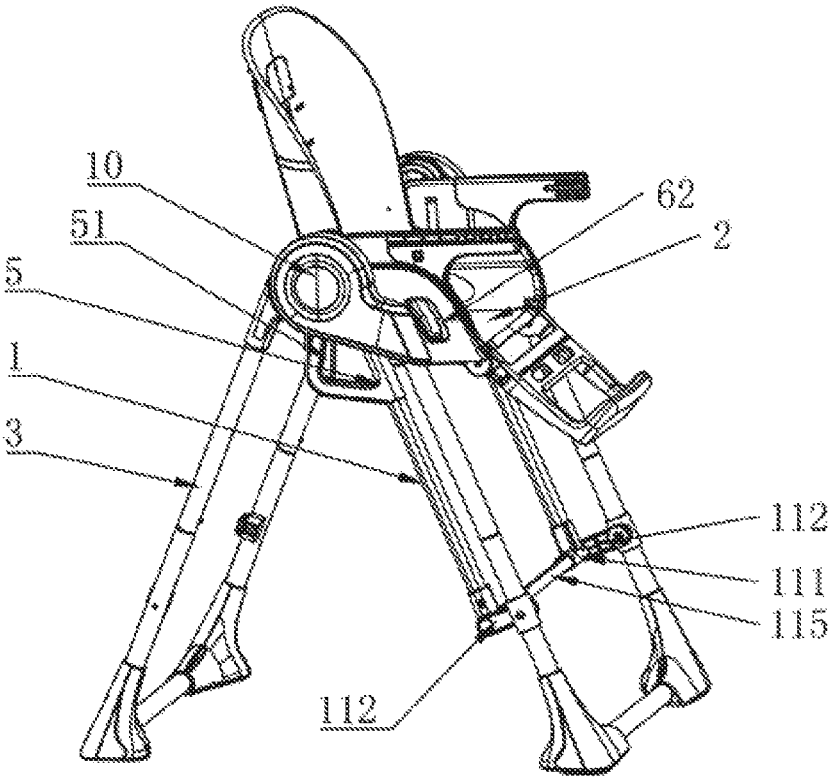
FIG. 1 is conceptual diagram illustrating an example structure of the present disclosure when used as a dining chair.

Figures are combined hereinafter to further elaborate the technical solution of the present disclosure.

As shown in FIGS. 1-15, the swing dining chair comprises supporting frames 3, swing arms 1 and a chair body 2, wherein the swing arm 1 is rotatably connected with the supporting frame 3, and a driving device 10 for driving the swing arm 1 to swing is arranged on the supporting frame 3. Specifically, the driving device 10 is a motor, which is provided with a speed-reducing device. When the motor is initiated, the motor drives the swing arm 1 to rotate relative to the supporting frame 3, thereby achieving the function of a swing.

The chair body 2 comprises a seat portion 21 and a backrest 22, wherein the seat portion 21 is rotatably connected with the backrest 22. A multi-stage included-angle adjustment device 4 is arranged between the seat portion 21 and the backrest 22, and the multi-stage included-angle adjustment device 4 is used for adjusting the position of the backrest 22 relative to the seat portion 21, thereby enabling the seat portion 21 and the backrest 22 to stay at multiple included-angle stages. The included-angle stages comprise a swing included-angle stage and a non-swing included-angle stage. Normally, when staying in the swing included-angle stage, the included angle formed between the backrest 22 and the seat portion 21 is relatively small, and when staying in the non-swing included-angle stage, the included angle formed between the backrest 22 and the seat portion 21 is relatively large. In this way, a high use safety is ensured.

The multi-stage included-angle adjustment device 4 comprises a stage block 41 arranged on the seat portion 21, and the stage block 41 is provided with an arc-shaped groove 42 matched with the rotation route of the backrest 22. A positioning block 43 is movably arranged on the backrest 22, and a pulling cord (not shown) in linkage with the positioning block 43 is arranged on the backrest 22. A positioning pin 44 in sliding fit with the arc-shaped groove 42 is arranged on the positioning block 43. The groove wall of the arc-shaped groove 42 is provided with a plurality of stage grooves 45 for receiving the positioning pin 44, and the plurality of stage grooves 45 are arranged at intervals.

In this embodiment, the groove wall of the arc-shaped groove 42 is provided with three stage grooves 45, which respectively are a swing stage groove 451, a first non-swing stage groove 452 and a second non-swing stage groove 453. The first non-swing stage groove 452 is located between the swing stage groove 451 and the second non-swing stage groove 453. When the positioning pin 44 is clamped into the swing stage groove 451, the backrest 22 stays at the swing included-angle stage relative to the seat portion 21, and when the positioning pin 44 is clamped into the first non-swing stage groove 452 or the second non-swing stage groove 453, the backrest 22 stays at the non-swing included-angle stage relative to the seat portion 21.

A positioning block spring (not shown) is arranged between the positioning block 43 and the backrest 22, and the positioning block spring is used for ensuring that the positioning pin 44 always possesses a motion tendency of being clamped into the stage groove 45.

When the angle of the backrest 22 needs to be adjusted, the pulling cord is pulled to propel the positioning block 43 to slide relative to the backrest 22, thus allowing the positioning pin 44 to escape from the corresponding stage groove 45. At this point, a user may pull the backrest 22 back and forth to make the positioning pin 44 slide in the arc-shaped groove 42. When the backrest 22 is adjusted to a proper position, the pulling cord is released, and the positioning block 43 automatically resets under the action of the positioning block spring. Thus, the positioning pin 44 is clamped into the corresponding stage groove 45. For instance, when the backrest 22 is adjusted to the first non-swing stage, the positioning pin 44 is clamped into the first non-swing stage groove 452.

The swing arm 1 is provided with a lifting base 5, which is in sliding fit with the swing arm 1 and is sleeved on the swing arm 1. A plurality of height positioning holes 11 are formed in the swing arm 1 at intervals along the length direction of the swing arm 1. The lifting base 5 is internally provided with a lifting button 51 matched with the height positioning hole 11 and a lifting spring 52 matched with the lifting button 51. The lifting spring 52 is used for ensuring that the lifting button 51 always possesses a motion tendency of being clamped into the height positioning hole 11. When the height of the lifting base 5 needs to be adjusted, the lifting button 51 is pulled such that it is separated from the height positioning hole 11. At this point, the height adjustment of the lifting base 5 is allowed. After being adjusted to a proper height, the lifting button 51 is released, and the lifting spring 52 propels the lifting button 51 such that it is clamped into the corresponding height positioning hole 11. Thus, the height adjustment of the lifting base 5 is realized.

Figure 2:
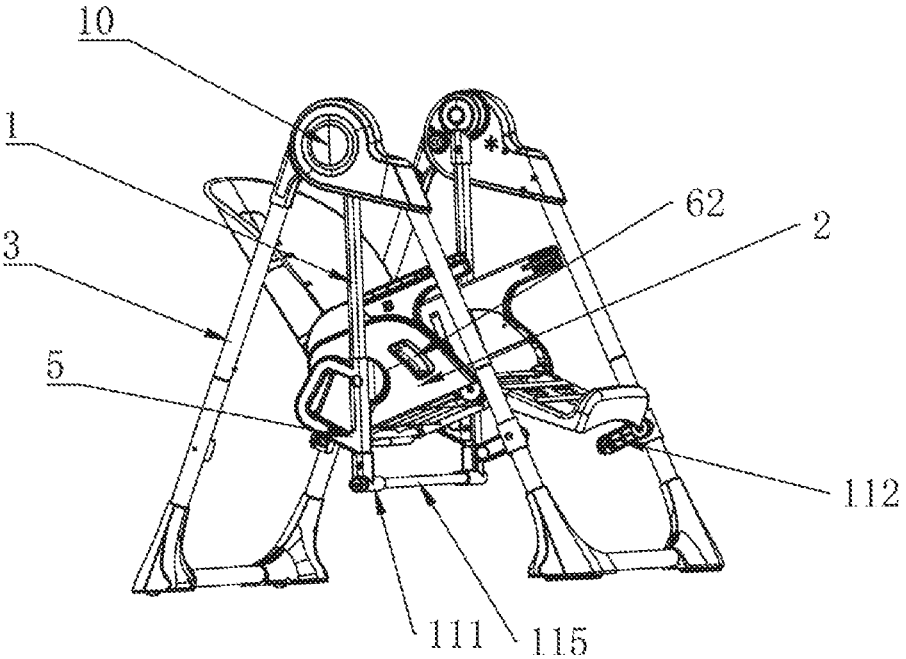
FIG. 2 is conceptual diagram illustrating an example structure of the present disclosure when used as a swing.
Figure 3:
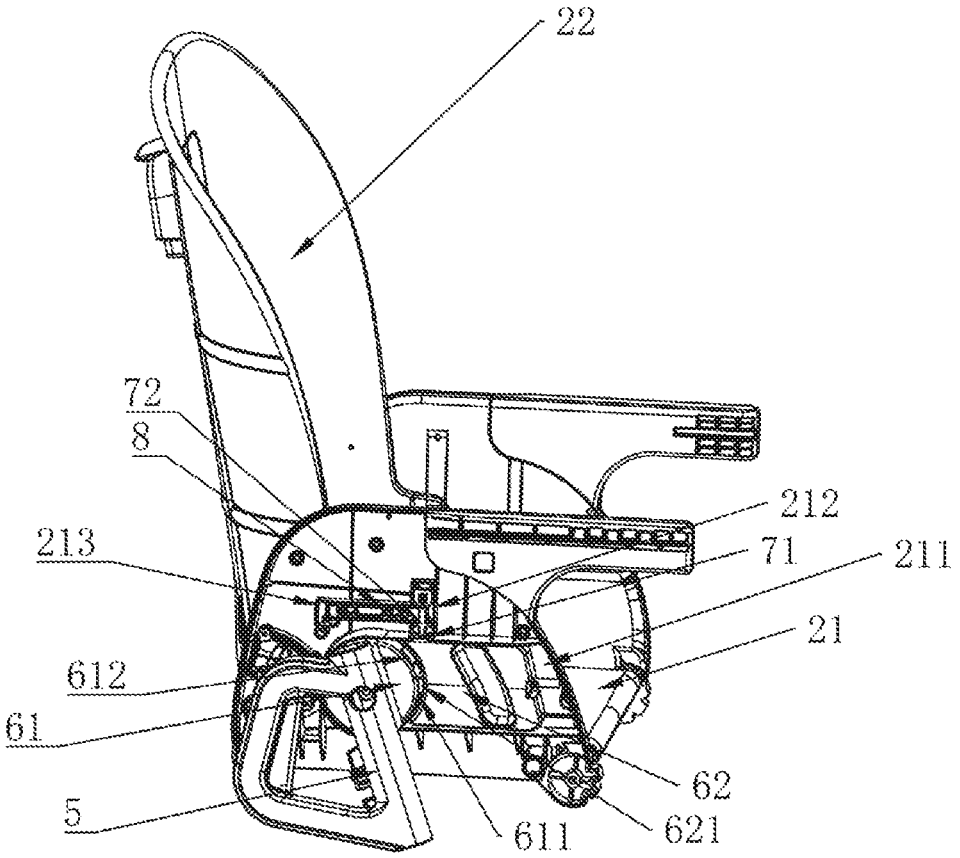
FIG. 3 is a conceptual diagram illustrating an internal assembled structure of the present disclosure.
Figure 4:
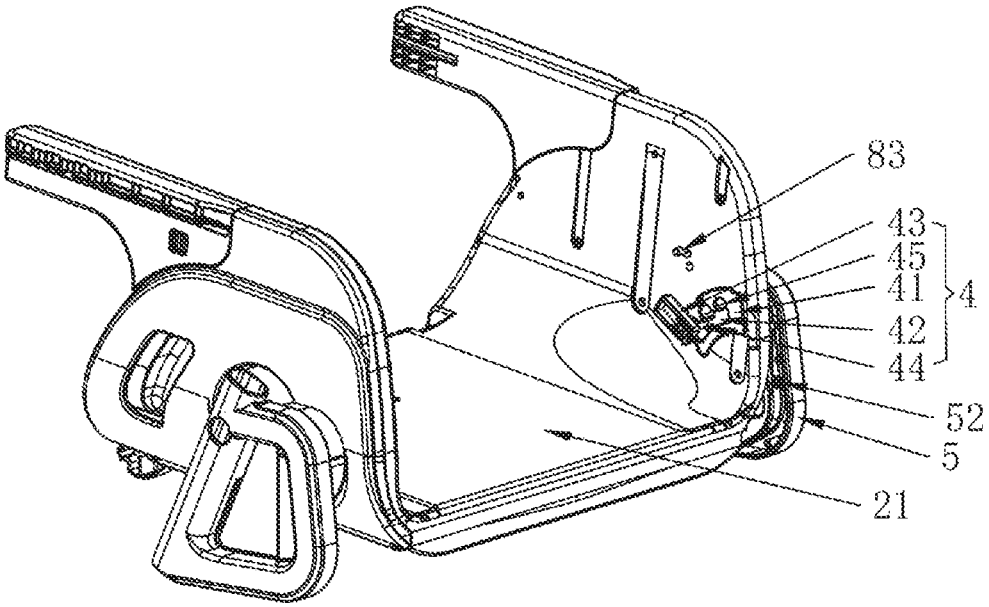
FIG. 4 is a conceptual diagram illustrating an assembled structure of the multi-stage included-angle adjustment device of the present disclosure.
Figure 5:
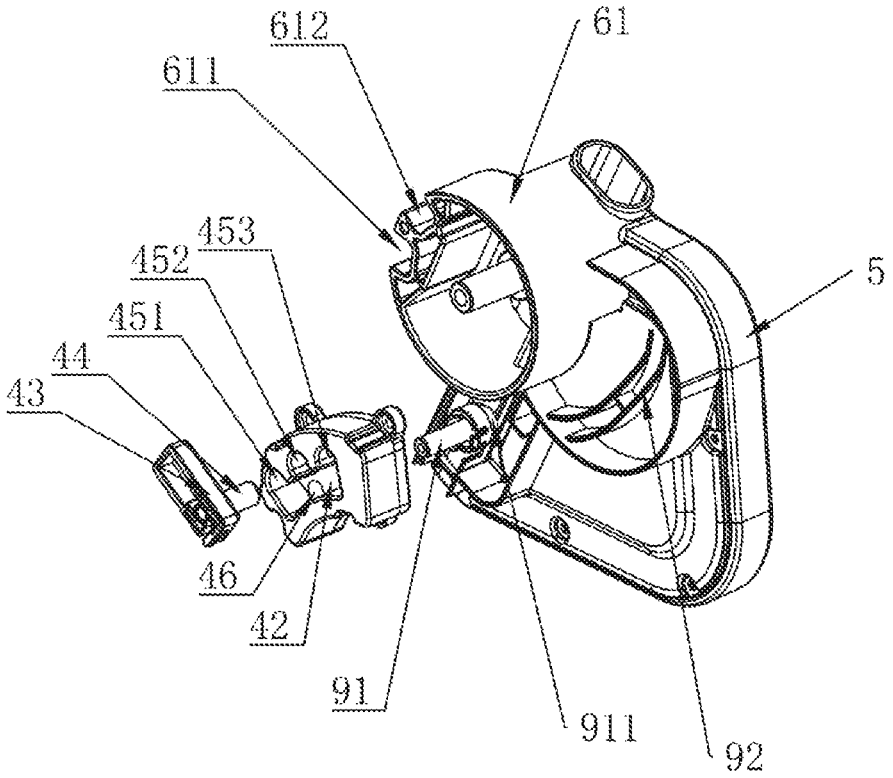
FIG. 5 is a conceptual diagram illustrating a disassembled structure of the multi-stage included-angle adjustment device and the third locking device of the present disclosure.
Figure 6:
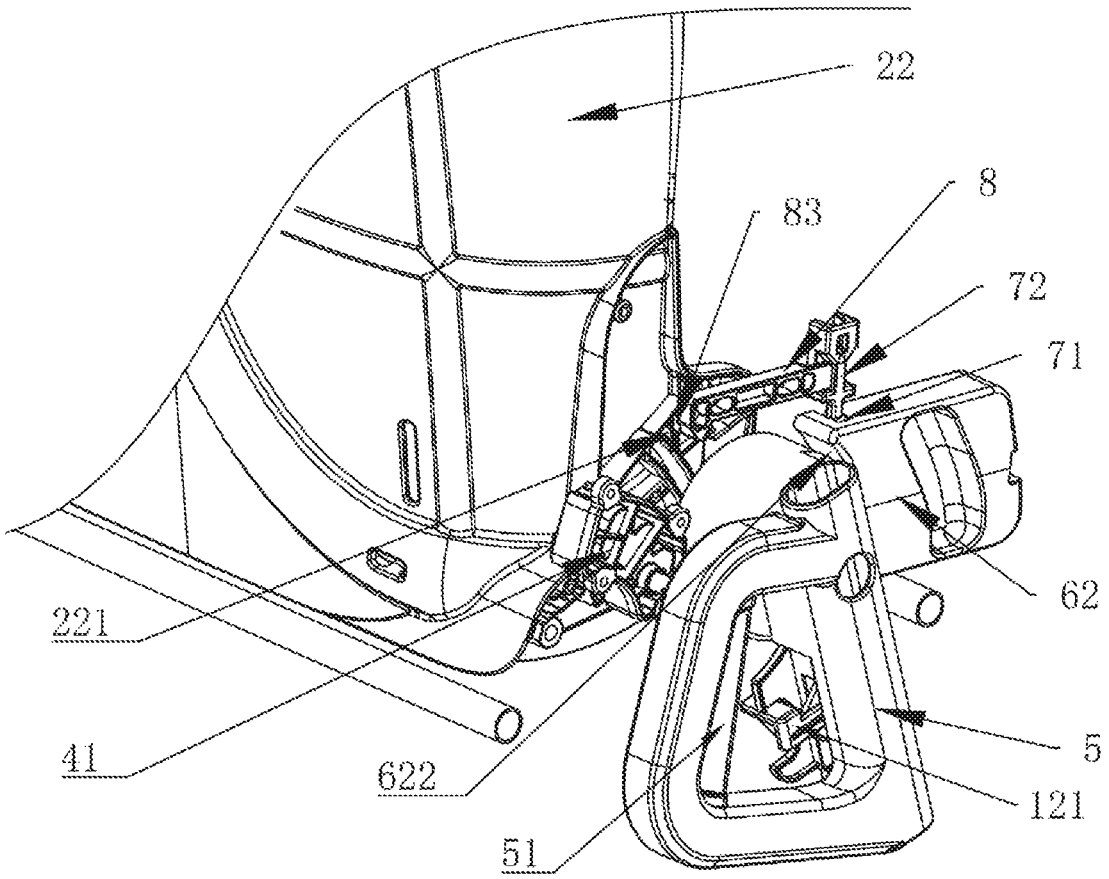
FIG. 6 is a conceptual diagram illustrating a partially-assembled structure of the present disclosure.
Figure 7:
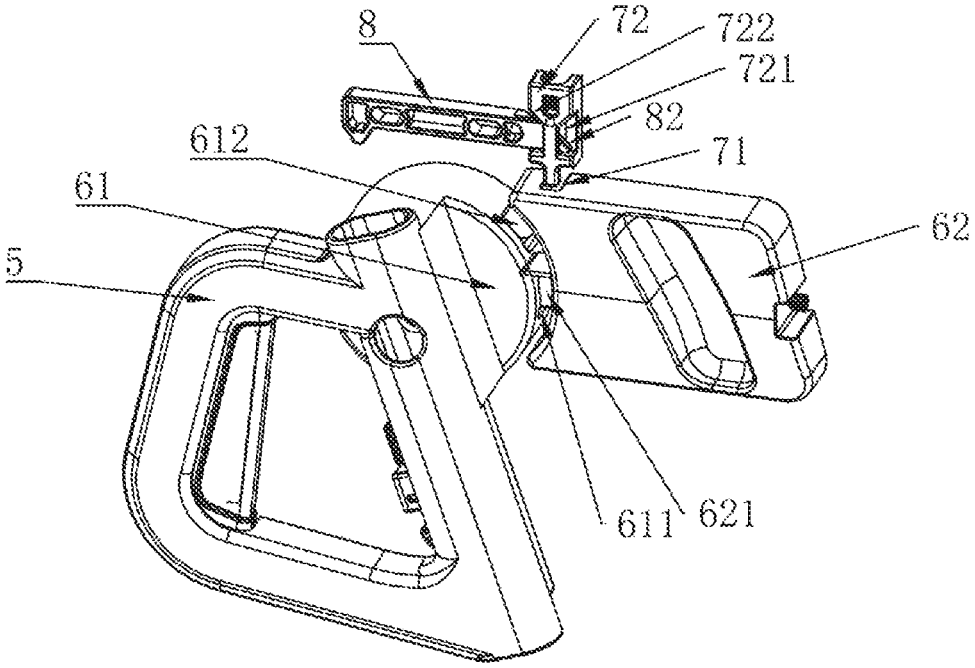
FIG. 7 is a conceptual diagram illustrating an assembled structure of the first locking device, the second locking device and the sliding connection rod of the present disclosure.
Figure 8:
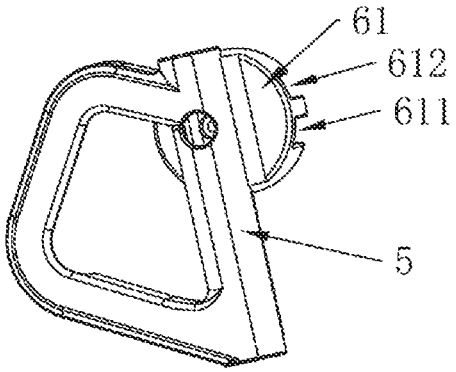
FIG. 8 is a conceptual diagram illustrating an example structure of the lifting base of the present disclosure.
Figure 9:
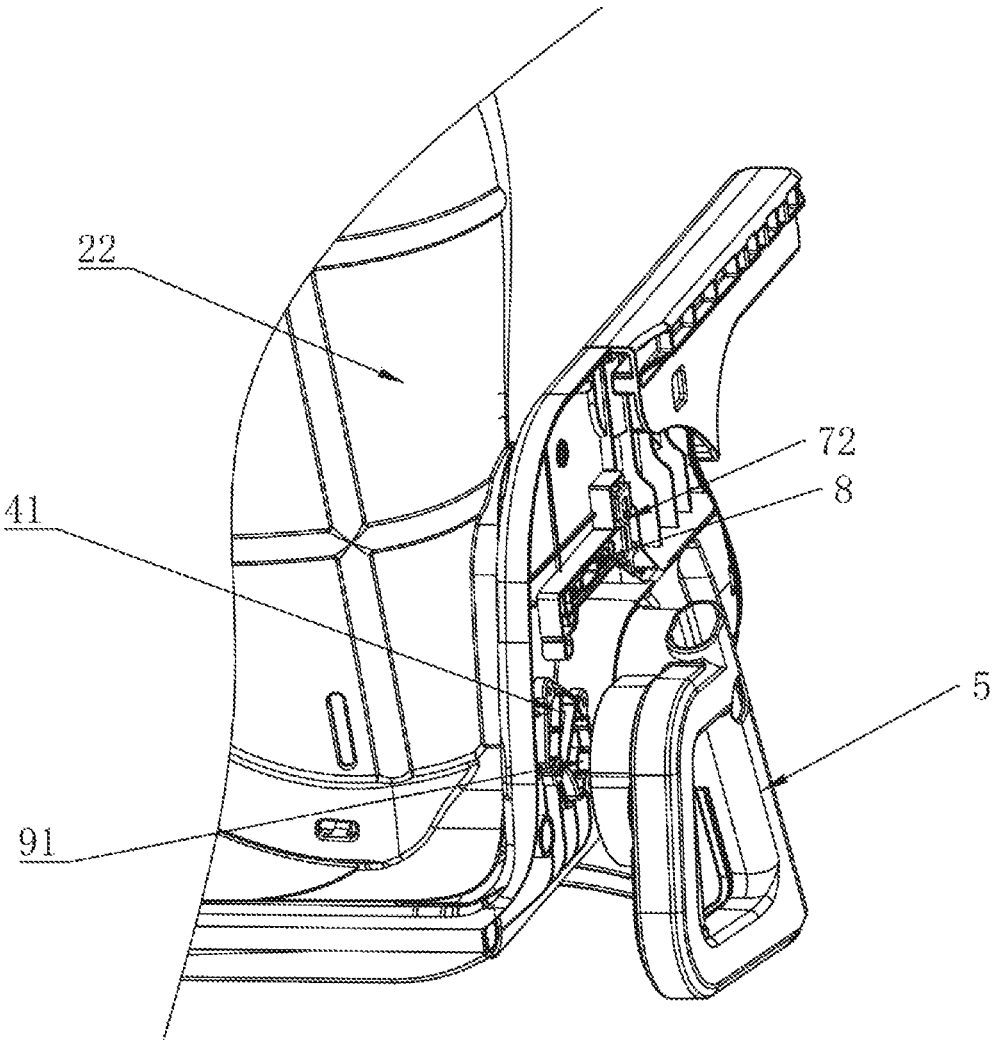
FIG. 9 is another conceptual diagram illustrating a partially-assembled structure of the present disclosure.
Figure 10:
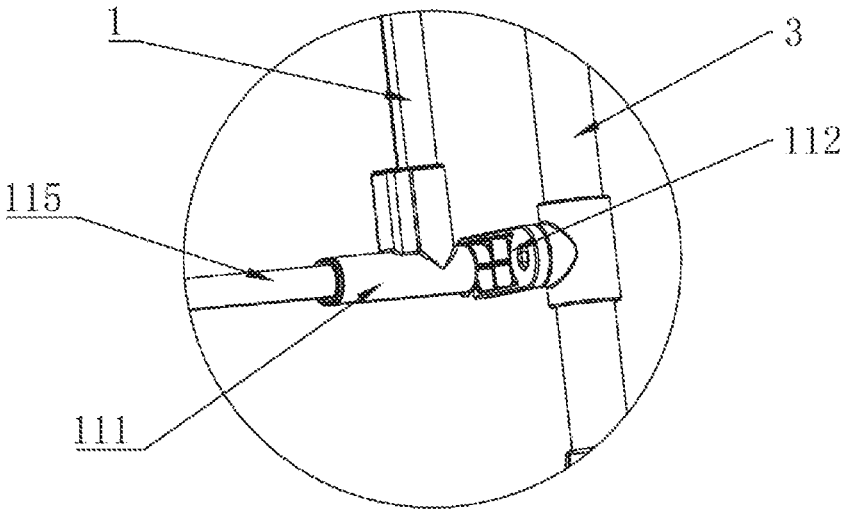
FIG. 10 is a conceptual diagram illustrating an assembled structure of the fourth locking device of the present disclosure.
Figure 11:
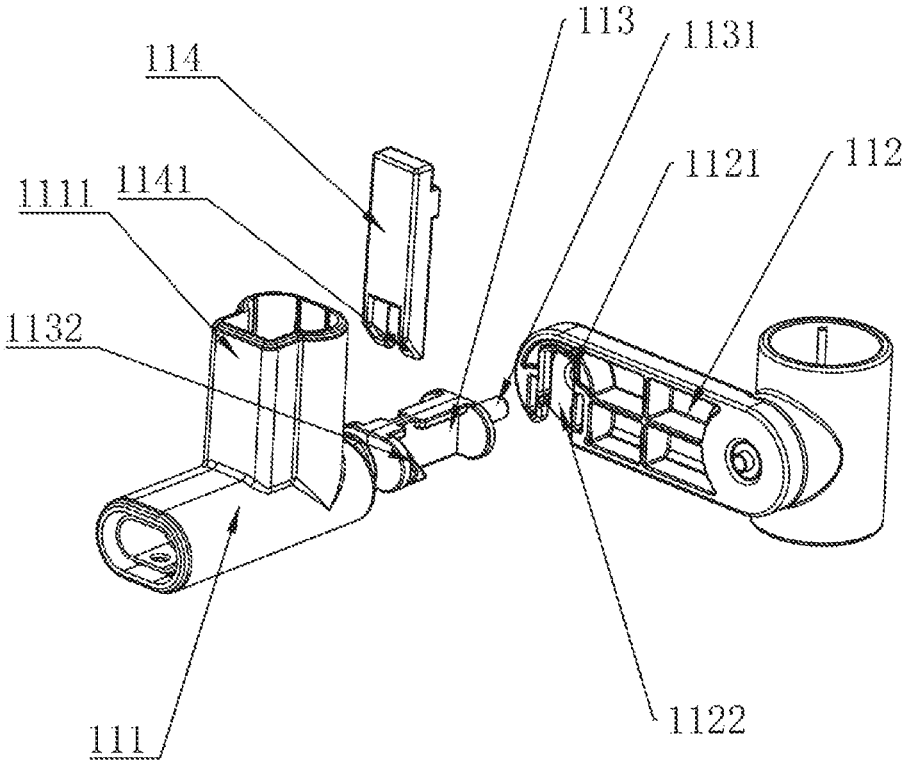
FIG. 11 is a conceptual diagram illustrating a disassembled structure of the fourth locking device of the present disclosure.
Figure 12:
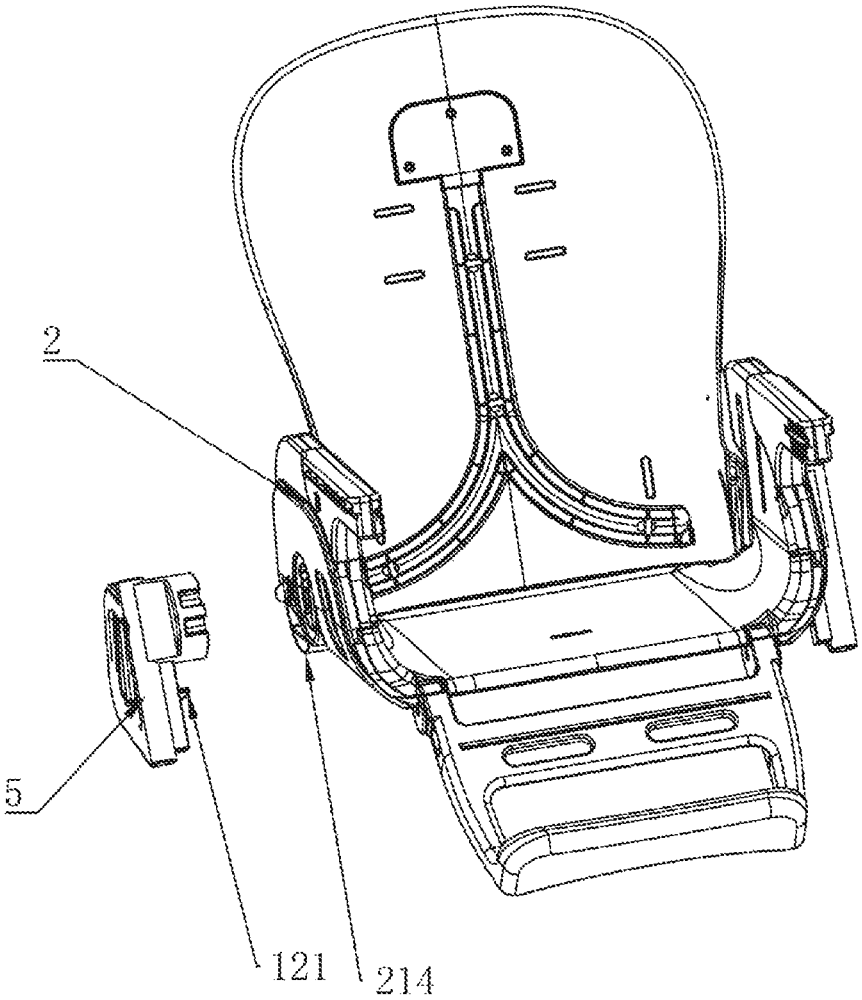
FIG. 12 is a conceptual diagram illustrating a disassembled structure of the second unlocking mechanism of the present disclosure.
Figure 13:
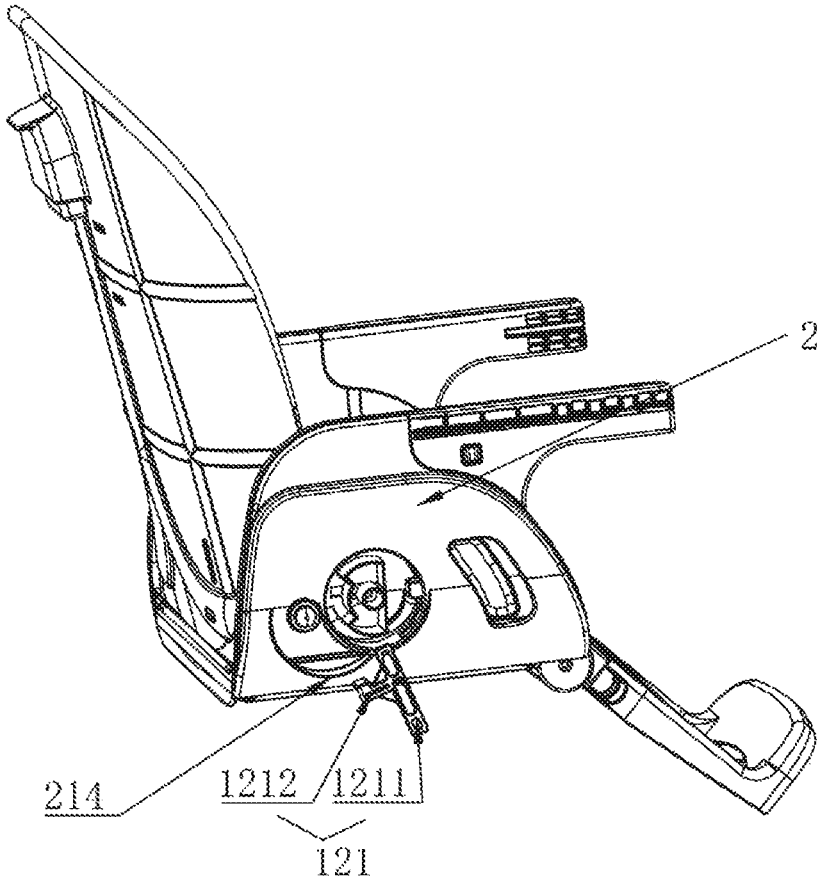
FIG. 13 is a conceptual diagram illustrating a linkage structure of the second unlocking mechanism of the present disclosure.
Figure 14:
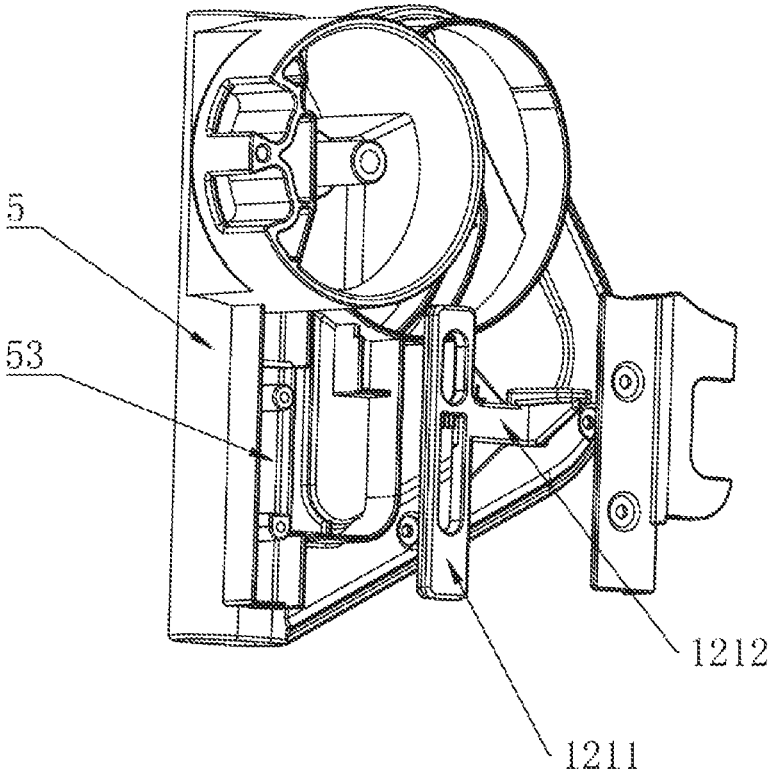
FIG. 14 is a conceptual diagram illustrating an assembled structure of the unlocking button of the present disclosure.
Figure 15:
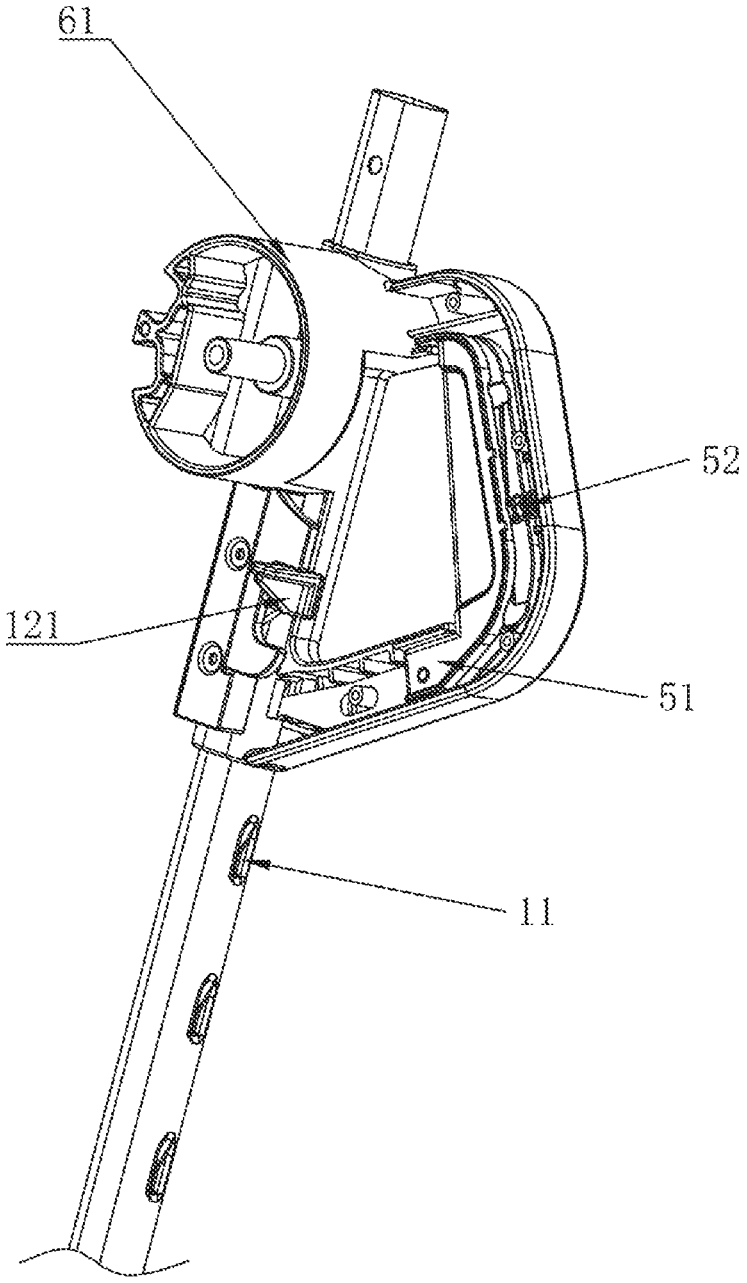
FIG. 15 is a conceptual diagram illustrating an assembled structure of the lifting base and the swing arm of the present disclosure.

The seat portion 21 is rotatably connected with the lifting base 5, and the seat portion 21 possesses at least a first angle position and a second angle position relative to the lifting base 5, wherein the first angle position is a dining chair state position (shown in FIG. 1), and the second angle position is a swing state position (shown in FIG. 2).

A first locking device is arranged between the seat portion 21 and the lifting base 5 for locking the seat portion 21 such that the seat portion 21 is relatively fixed with the lifting base 5. The first locking device comprises a locking disc 61 arranged on the lifting base 5 and a pulling plate 62 which is arranged on the seat portion 21 and corresponds to the locking disc 61. A pulling plate sliding groove 211 is transversely formed in the seat portion 21, and the pulling plate 62 transversely slidably interacts with the seat portion 21 through the pulling plate sliding groove 211. The locking disc 61 is provided with a locking groove 611, and the pulling plate 62 is provided with a locking pin 621. In this embodiment, to prevent the pulling plate 62 and the locking disc 61 from interfering with each other when the seat portion 21 rotates relative to the lifting base 5, one end of the pulling plate 62 close to the locking disc 61 is provided with an arc-shaped surface 622 matched with the locking disc 61. The locking pin 621 is arranged on the arc-shaped surface 622, and the seat portion 21 is provided with a pulling plate spring (not shown) matched with the pulling plate 62. The pulling plate spring abuts against the pulling plate 62, thereby enabling the locking pin 621 to insert into the locking groove 611.

Additionally, the locking disc 61 is provided with a swing positioning groove 612. The swing positioning groove 612 is located beside the locking groove 611, and the locking pin 621 interacts with the swing positioning groove 612 in an inserting mode. When the swing dining chair is adjusted into a swing state, the locking pin 621 is inserted into the swing positioning groove 612, which effectively prevents the chair body from shaking such that a high stability is ensured.

The seat portion 21 is provided with a second locking device for locking the first locking device. The second locking device comprises a pin hole 71 formed in the pulling plate 62 and a shift pin 72 which is arranged on the seat portion 21 and corresponds to the pulling plate 62. The seat portion 21 is longitudinally provided with a pin sliding groove 212, and the shift pin 72 is longitudinally slidably interacts with the seat portion 21 through the pin sliding groove 212. The shift pin 72 is in linkage with a first unlocking mechanism. The seat portion 21 is provided with a pin spring matched with the shift pin 72 (not shown). The pin spring abuts against the shift pin 72, thus enabling the shift pin 72 to insert into the pin hole 71.

The first unlocking mechanism is arranged on the seat portion 21 for unlocking the second locking device. The first unlocking mechanism comprises a sliding connection rod 8 arranged in the seat portion 21. The seat portion 21 is transversely provided with a connection rod sliding groove 213, and the sliding connection rod 8 transversely slidably interacts with the seat portion 21 through the connection rod sliding groove 213. The sliding connection rod 8 is provided with a linkage post 83, and the backrest 22 is provided with a linkage baffle 221. The shift pin 72 is provided with an inserting hole 721 for receiving the end portion of the sliding connection rod 8, and the hole wall of the inserting hole 721 is provided with a pin inclined surface 722. The end portion of the sliding connection rod 8 is provided with a connection rod inclined surface 82 matched with the pin inclined surface 722. When the backrest 22 is adjusted to the swing included-angle stage from the non-swing included-angle stage relative to the seat portion 21, the linkage baffle 221 abuts against the linkage post 83. At this point, the sliding connection rod 8 moves towards the shift pin 72, and the connection rod inclined surface 82 abuts against the pin inclined surface 722, which enables the shift pin 72 to escape from the pin hole 71. Thus, the first unlocking mechanism unlocks the second locking device, thereby keeping the first locking device in a moving state.

In this embodiment, specifically, through pulling the pulling cord and the backrest 22, the backrest 22 rotates relative to the seat portion 21, and the positioning pin 44 moves along the arc-shaped groove 42. When the positioning pin 44 crosses the first non-swing stage groove 452 and approaches the swing stage groove 451, the linkage baffle 221 starts abutting against the linkage post 83. At this point, the backrest 22 propels the sliding connection rod 8 to move, and the sliding connection rod 8 propels the second locking device to unlock the first locking device.

It should be noted that, when the positioning pin 44 moves between a first non-swing stage groove 452 and a second non-swing stage groove 453, as staying at the non-swing stage, the linkage baffle 221 does not abut against the linkage post 83, meaning that the sliding connection rod 8 does not move at this time. When the positioning pin 44 moves to the first non-swing stage groove 452 or the second non-swing stage groove 453 from the swing stage groove 451, the linkage baffle 221 no longer imposes a force on the linkage post 83, at which point the sliding connection rod 8 is reset by means of the reverse acting force of the pin spring under the interaction between the pin inclined surface 722 and the connection rod inclined surface 82.

A third locking device is arranged between the seat portion 21 and the lifting base 5, and the third locking device is in linkage with the lifting base 5. When the seat portion 21 is adjusted from the first angle position to the second angle position relative to the lifting base 5 (namely, the dining chair state is adjusted to the swing state), the lifting base 5 propels the third locking device to lock the multi-stage included-angle adjustment device 4, thereby fixing the backrest 22 at the swing included-angle stage relative to the seat portion 21.

The third locking device comprises a locking button 91 movably arranged on the seat portion 21 and an inclined surface step 92 which is arranged on the lifting base 5 and abuts against the locking button 91, wherein the inclined surface step 92 is configured to be spiral-shaped. One end of the locking button 91 close to the inclined surface step 92 is provided with a spherical surface 911, which allows the inclined surface step 92 to better trigger the locking button 91. The arc-shaped groove 42 of the stage block 41 is provided with a through-hole 46, and the through-hole 46 is formed between the stage groove 45 corresponding to the swing included-angle stage and the stage groove 45 corresponding to the non-swing included-angle stage adjacent to the swing included-angle stage. In this embodiment, the through-hole 46 is formed between the swing stage groove 451 and the first non-swing stage groove 452, and one end of the locking button 91 far away from the inclined surface step 92 is movably inserted into the through-hole 46.

When the seat portion 21 is adjusted from the first angle position to the second angle position relative to the lifting base 5, the inclined surface step 92 pushes the locking button 91 to move, and the locking button 91 extends out from the through-hole 46, thus locking the positioning pin 44 of the multi-stage included-angle adjustment device 4. The locking button 91 is provided with a button spring for ensuring that the locking button 91 always possesses a motion tendency of unlocking the multi-stage included-angle adjustment device 4.

A fourth locking device is arranged between the swing arm 1 and the supporting frame 3. The fourth locking device is used for locking the swing arm 1 such that the swing arm 1 is fixed relative to the supporting frame 3. The fourth locking device is located on the sliding track of the lifting base 5. Specifically, the fourth locking device is arranged at the bottom of the swing arm 1 and the supporting frame 3. In this embodiment, the swing dining chair has two swing arms and is provided with fourth locking devices in one-to-one correspondence with the two swing arms 1.

The fourth locking device comprises a locking shell 111, a locking base 112, a locking tongue 113 and a trigger button 114. The locking shell 111 is fixedly arranged on the swing arm 1, the locking base 112 is rotatably arranged on the supporting frame 3, and a joint rod 115 is connected between the locking shells of the two fourth locking devices. The locking tongue 113 is transversely movably arranged in the locking shell 111, and the locking base 112 is provided with a locking hole 1121 for receiving the locking tongue 113. More specifically, one end of the locking tongue 113 close to the locking base 112 is provided with a locking post 1131 interacting with the locking hole 1121. When the fourth locking device is in a locked state, the opposite ends of the locking shell 111 and the locking base 112 are attached to each other, thus effectively preventing a user from touching the locking tongue by mistake Thus, a high use safety is achieved.

A first return spring (not shown) is arranged in the locking shell 111, and the first return spring is used for ensuring that the locking tongue 113 always possesses a motion tendency of being clamped into the locking hole 1121. The trigger button 114 is longitudinally movably arranged in the locking shell 111. The upper end of the trigger button 114 is in linkage with a second unlocking mechanism, and the lower end of the trigger button 114 is in linkage with the locking tongue 113. More specifically, the locking tongue 113 is provided with a locking tongue inclined surface 1132, and the lower end of the trigger button 114 is provided with a trigger button inclined surface 1141 abutting against the locking tongue inclined surface 1132.

When the locking post 1131 of the lock tongue 113 is clamped into the locking hole 1121, the locking shell 111 is connected with the locking base 112 and the locking device is locked. At this point, the swing arm 1 does not rotate relative to the supporting frame 3. When the trigger button 114 moves down under the action of a pressing force, the trigger button inclined surface 1141 pushes the locking tongue inclined surface 1132, so that the locking tongue 113 moves transversely against the elastic force of the return spring. Thus, the locking post 1131 is separated from the locking hole 1121, thus unlocking the fourth locking device.

In this embodiment, to allow the locking post 1131 to escape the locking base 112 after being separated from the locking hole 1121, the side of the locking hole 1121 is provided with a locking base sliding groove 1122 for allowing the locking post 1131 to slide out of the locking base 112. The depth of the locking hole 1121 is deeper than that of the locking base sliding groove 1122, which effectively ensures the stability when locking. The inner end of the locking base sliding groove 1122 is communicated with the locking hole 1121, and the outer end of the locking base sliding groove 1122 extends throughout the side wall of the locking base 112. When the locking post 1131 is separated from the locking hole 1121, the locking post 1131 slides into the locking base sliding groove 1122, and at this point, a user may pull the locking shell 111 and the locking base 112, thereby allowing the locking post 1131 to escape the locking base 112.

The locking shell 111 has a shielding portion 1111, the trigger button 114 is hidden in the shielding portion 1111, and the upper end of the shielding portion 1111 is provided with an opening. Through adopting the aforesaid structure, the maloperation is effectively avoided and the use safety is further improved.

The lifting base 5 is provided with a second unlocking mechanism for unlocking the fourth locking device, and the second unlocking mechanism is in linkage with the seat portion 21. When the seat portion 21 is adjusted from the first angle position to the second angle position relative to the lifting base 5, the seat portion 21 propels the second unlocking mechanism to act.

More specifically, the second unlocking mechanism comprises an unlocking button 121 which is movably arranged in the lifting base 5 and is in linkage with the trigger button 114, and an arc-shaped portion 214 which is arranged on the seat portion 21 and is in linkage with the unlocking button 121. The arc-shaped portion 214 is an arc-shaped plate formed on the outer wall of the chair body 2. Its integrally-formed structure greatly saves the cost and simplifies the assembly. The arc-shaped portion 214 is located obliquely below the rotation fulcrum of the chair body 2 and the lifting base 5, which ensures that the arc-shaped portion 214 touches the unlocking button 121 when the chair body 2 rotates.

The unlocking button 121 comprises a first rod portion 1211 and a second rod portion 1212 which are connected, and a slideway 53 which is in sliding fit with the first rod portion 1211 is arranged in the lifting base 5. The first return spring abuts between the lifting base 5 and the first rod portion 1211, and the first rod portion 1211 is in linkage with the trigger button 114. The second rod portion 1212 extends out of the lifting base 5, and the arc-shaped portion 214 is in linkage with the second rod portion 1212.

The length of the slideway 53 is adapted to the length of the first rod portion 1211. When the chair body 2 is located at the first angle position, the first rod portion 1211 is hidden in the slideway 53, and when the chair body 2 is located at the second angle position, the end portion of the first rod portion 1211 extends out of the slideway 53. By means of the aforesaid structural design, when the swing dining chair is used as a dining chair, the unlocking end of the unlocking button 121 is in a hidden state, which further prevents the maloperation and ensures a high use safety.

The center of the arc-shaped portion 214 is eccentrically arranged relative to the rotation fulcrum of the chair body 2 and the lifting base 5, and the arc-shaped portion 214 is eccentrically arranged. Thus, when the chair body 2 rotates from the first angle position to the second angle position, the arc-shaped portion 214 acts on the unlocking button 121, and when the chair body 2 rotates from the second angle position to the first angle position, the arc-shaped portion 214 does not act on the unlocking button 121.

The lifting base 5 is internally provided with a second return spring (not shown) abutting against the unlocking button 121, and the second return spring is used for ensuring that the unlocking button 121 always possesses a motion tendency of being away from the trigger button 114.

When the seat portion 21 is adjusted from the first angle position to the second angle position, the seat portion 21 rotates relative to the lifting base 5, and the arc-shaped portion 214 abuts against the second rod portion 1212. In response to that, the second rod portion 1212 propels the first rod portion 1211 to move down along the lifting base 5, thereby allowing the first rod portion 1211 to stay at a position where it is able to press the trigger button 114 relative to the lifting base 5 (namely, the lower end of the first rod portion 1211 extends out of the slideway 53). At this point, the lifting base 5 slides down, and when the unlocking end (namely, the lower end) of the second rod portion 1212 touches the trigger button 114, the trigger button 114 moves down under the action of the pushing force imposed by the second rod portion 1212, thereby propelling the locking tongue 113 to move. Subsequently, the locking post 1131 of the locking tongue 113 is separated from the locking hole 1121 and slides into the locking base sliding grove 1122. At this time, a user may pull the locking shell 111 and the locking base 112 to enable the locking post 1131 to escape from the locking base 112. Thus, the locking device is unlocked.

The above are merely preferred embodiments of the present disclosure. All equivalent alterations or modifications made according to the structures, features and principles described in the specification of the present disclosure shall fall into the scope of the present disclosure.

What is claimed is:

1. A swing dining chair, comprising:

supporting frames, swing arms, and a chair body, wherein each swing arm is rotatably connected with a respective supporting frame, and a driving device for driving the swing arm to swing is arranged on the supporting frame, wherein the chair body comprises:

a seat portion and a backrest, and the seat portion is rotatably connected with the backrest, wherein a multi-stage included-angle adjustment device is arranged between the seat portion and the backrest, and the multi-stage included-angle adjustment device is used for adjusting the position of the backrest relative to the seat portion, thereby enabling the seat portion and the backrest to stay at multiple included-angle stages, wherein the multiple included-angle stages comprise:

a swing included-angle stage and a non-swing included-angle stage, wherein the swing arm is provided with a lifting base, which is in sliding fit with the swing arm, wherein the seat portion is rotatably connected with the lifting base, and the seat portion is configured in at least a first angle position and a second angle position relative to the lifting base, wherein a first locking device is arranged between the seat portion and the lifting base for locking the seat portion such that the seat portion is relatively fixed with the lifting base, wherein the seat portion is provided with a second locking device for locking the first locking device, wherein the seat portion is provided with a first unlocking mechanism for unlocking the second locking device, wherein when the backrest is adjusted to the swing included-angle stage from the non-swing included-angle stage relative to the seat portion, the first unlocking mechanism unlocks the second locking device, wherein a third locking device is arranged between the seat portion and the lifting base, and the third locking device is in linkage with the lifting base, wherein when the seat portion is adjusted from the first angle position to the second angle position relative to the lifting base, the lifting base propels the third locking device to lock the multi-stage included-angle adjustment device at the swing included-angle stage relative to the seat portion, wherein a fourth locking device is arranged between the swing arm and the supporting frame, wherein the fourth locking device is used for locking the swing arm such that the swing arm is fixed relative to the supporting frame, wherein the fourth locking device is located on a sliding track of the lifting base, wherein the lifting base is provided with a second unlocking mechanism for unlocking the fourth locking device, and the second unlocking mechanism is in linkage with the seat portion, wherein when the seat portion is adjusted from the first angle position to the second angle position relative to the lifting base, the seat portion propels the second unlocking mechanism to act.

2. The swing dining chair of claim 1, wherein the first locking device comprises:

a locking disc arranged on the lifting base and a pulling plate which is arranged on the seat portion and corresponds in position to the locking disc, wherein the pulling plate slidably interacts with the seat portion, wherein the locking disc is provided with a locking groove, and the pulling plate is provided with a locking pin, wherein the seat portion is provided with a pulling plate spring matched with the pulling plate, wherein the pulling plate spring abuts against the pulling plate, thereby enabling the locking pin to be inserted into the locking groove.

3. The swing dining chair of claim 2, wherein the second locking device comprises:

a pin hole formed in the pulling plate and a shift pin which is arranged on the seat portion and corresponds in position to the pulling plate, wherein the shift pin slidably interacts with the seat portion, and the shift pin is in linkage with the first unlocking mechanism, wherein the seat portion is provided with a pin spring matched with the shift pin, and the pin spring abuts against the shift pin, thus causing the shift pin to be inserted into the pin hole.

4. The swing dining chair of claim 3, wherein the first unlocking mechanism comprises:

a sliding connection rod arranged in the seat portion, and the sliding connection rod is in linkage with the backrest, wherein the shift pin is provided with an inserting hole for receiving the end portion of the sliding connection rod, and the hole wall of the inserting hole is provided with a pin inclined surface, wherein the end portion of the sliding connection rod is provided with a connection rod inclined surface matched with the pin inclined surface, wherein when the backrest is adjusted to the swing included-angle stage from the non-swing included-angle stage relative to the seat portion, the sliding connection rod moves towards the shift pin, and the connection rod inclined surface abuts against the pin inclined surface, thereby causing the shift pin to escape from the pin hole.

5. The swing dining chair of claim 4, wherein the sliding connection rod is provided with a linkage post, and the backrest is provided with a linkage baffle, wherein when the backrest is adjusted to the swing included-angle stage from the non-swing included-angle stage relative to the seat portion, the linkage baffle abuts against and is in linkage with the linkage post.

6. The swing dining chair of claim 1, wherein the third locking device comprises:

a locking button movably arranged on the seat portion and an inclined surface step which is arranged on the lifting base and abuts against the locking button, wherein when the seat portion is adjusted from the first angle position to the second angle position relative to the lifting base, the inclined surface step propels the locking button to move such that the multi-stage included-angle adjustment device is locked by the locking button, wherein the locking button is provided with a button spring for ensuring that the locking button always possesses a motion tendency of unlocking the multi-stage included-angle adjustment device.

7. The swing dining chair of claim 6, wherein the multi-stage included-angle adjustment device comprises:

a stage block arranged on the seat portion, and the stage block is provided with an arc-shaped groove matched with a rotation route of the backrest, wherein a positioning block is movably arranged on the backrest, and a pulling cord in linkage with the positioning block is arranged on the backrest, wherein a positioning pin in sliding fit with the arc-shaped groove is arranged on the positioning block, wherein a groove wall of the arc-shaped groove is provided with a plurality of stage grooves for receiving the positioning pin, and the plurality of stage grooves are arranged at intervals, wherein a positioning block spring is arranged between the positioning block and the backrest, and the positioning block spring is used for ensuring that the positioning pin always possesses a motion tendency of being clamped into one of the stage grooves.

8. The swing dining chair of claim 7, wherein the arc-shaped groove of the stage block is provided with a through-hole, and the through-hole is formed between the stage groove corresponding to the swing included-angle stage and the stage groove corresponding to the non-swing included-angle stage adjacent to the swing included-angle stage, wherein one end of the locking button far away from the inclined surface step is movably inserted into the through-hole.

9. The swing dining chair of claim 1, wherein the fourth locking device comprises:

a locking shell, a locking base, a locking tongue and a trigger button, wherein the locking shell is fixedly arranged on the swing arm, and the locking base is arranged on the supporting frame, wherein the locking tongue is transversely movably arranged in the locking shell, wherein a first return spring is arranged in the locking shell, and the first return spring is used for ensuring that the locking tongue always possesses a motion tendency of being clamped into a locking hole of the locking base, wherein the trigger button is longitudinally movably arranged in the locking shell, wherein the upper end of the trigger button is in linkage with the second unlocking mechanism, and the lower end of the trigger button is in linkage with the locking tongue, wherein when the trigger button is pressed, the trigger button pushes the locking tongue to move transversely against the elastic force of the first return spring, thus unlocking the fourth locking device.

10. The swing dining chair of claim 9, wherein the second unlocking mechanism comprises:

an unlocking button which is movably arranged in the lifting base and is in linkage with the trigger button, and an arc-shaped portion which is arranged on the seat portion and is in linkage with the unlocking button, wherein a center of the arc-shaped portion is eccentrically arranged relative to a rotation fulcrum of the chair body and the lifting base, wherein the lifting base is internally provided with a second return spring abutting against the unlocking button, and the second return spring is used for ensuring that the unlocking button always possesses a motion tendency of being away from the trigger button.

* * * * *